US005165267A

United States Patent [19]

Watanabe et al.

[11] Patent Number: 5,165,267

[45] Date of Patent: Nov. 24, 1992

[54] CURLING APPARATUS

[75] Inventors: Osamu Watanabe; Yoshiaki Nagashigi, both of Katano; Masaya Tanshin, Kyoto, all of Japan

[73] Assignee: Matsushita Electric Industrial Co., Ltd., Osaka, Japan

[21] Appl. No.: 703,460

[22] Filed: May 21, 1991

[30] Foreign Application Priority Data

May 22, 1990 [JP] Japan ..... 2-130196

[51] Int. Cl.[5] ..... B21D 19/12

[52] U.S. Cl. ..... 72/118; 72/125

[58] Field of Search ..... 72/125, 124, 126, 115, 72/117, 118, 119

[56] References Cited

U.S. PATENT DOCUMENTS

| | | | |
|---|---|---|---|
| 121,512 | 12/1871 | Hamilton | 72/125 |
| 897,175 | 8/1908 | Tassey et al. | 72/125 |
| 1,222,679 | 4/1917 | Schneider | 72/125 |
| 1,983,407 | 12/1934 | Scholtes | 72/118 |
| 4,747,287 | 5/1988 | Azzaline et al. | 72/125 |

FOREIGN PATENT DOCUMENTS

| | | | |
|---|---|---|---|
| 0199819 | 7/1967 | U.S.S.R. | 72/125 |

*Primary Examiner*—David Jones

*Attorney, Agent, or Firm*—Ratner & Prestia

[57] ABSTRACT

A plurality of rolls are supported and freely shiftable on a rotating supporting shaft. The rolls have a V-groove with a circular arc at the bottom of the groove. The plurality of rolls are arranged on a swivel table so that the rotating supporting shaft corresponds to the radial direction of the swivel table. A component of force acting on the roll in the direction of the supporting shaft is alleviated by a shift of each roll in the direction of the supporting shaft. This is accomplished by rotating the swivel table with the bottom of a metal sheet tapered cylinder pushed down against the V-groove. Thus, curling on the lower end of the cylinder is accomplished without generating a bulge in the neighborhood of the lower end of the cylinder and without preforming.

2 Claims, 7 Drawing Sheets

CURLING APPARATUS

BACKGROUND OF THE INVENTION

The present invention relates to a curling apparatus for curling the end of a tapered cylinder made of sheet metal.

A conventional method of curling the end of a tapered cylinder is explained with reference to FIG. 11 through FIG. 13, in which FIG. 11 and FIG. 12 are enlarged sectional drawings showing the relationship between a workpiece and a conventional curling apparatus.

In FIG. 11, a roll base consists of a roll 1 for spinning work, along the outer peripheral of which a V-groove is formed with the bottom surface shaped through a circular arc, a radial bearing 2 being fastened to the surface of an inside diameter, a supporting shaft 4 to support the roll 1 universally rotatable together with thrust bearings 3 disposed on both ends, and a supporting stand 7 which is disposed radially on a periphery of a swiveling table 6 and which is fastened to the supporting shaft 4 with a key 5.

A tapered cylinder 8 made of steel metal for curling work is formed in advance with a pre-curved area 8*a* on a curling side of the lower end.

The conventional curling apparatus is arranged with more than 3 roll tables which are radially arranged at equal intervals and is disposed concentrically on a power-driven swiveling table 6, and is provided with a pressure device (not illustrated here) for pushing down a tapered cylinder 8 on an upper part. Explanation follows of the operation of the curling apparatus thus structured. As shown in FIG. 11, by mounting a preformed tapered cylinder 8 on the roll 1 situated on the roll table, push the tapered cylinder 8 is pushed with the pressure apparatus against the roll 1 by rotating swiveling table 6. The roll 1 rotates universally on the supporting shaft 4 against a friction force with the tapered cylinder 8, and as shown in FIG. 12, the V-groove 1*a* serves as a guide to roll the periphery of the lower end of the tapered cylinder 8 to the inside.

However, with the structure as mentioned above, the radial position of the roll 1 so fastened with the thrust bearing 3 prevents the formation of a desirable, complete tapered surface. Instead, as shown in FIG. 13, a bulge 8*a* is generated in the neighborhood of the lower end of the tapered cylinder 8 due to a radial component generated when it is guided by an outer wall of the V-groove 1*a* as shown with an arrow B.

SUMMARY OF THE INVENTION

The purpose of the present invention is to solve the above problem, and hence provide a curling apparatus which will not generate bulges.

In order to solve the above problem, the present invention makes the roll 1 slide along the axis of the supporting shaft.

DETAILED DISCLOSURE OF THE INVENTION

Explanation follows below of the embodiment of the present invention with reference to FIG. 1 through FIG. 10.

Figure 1:
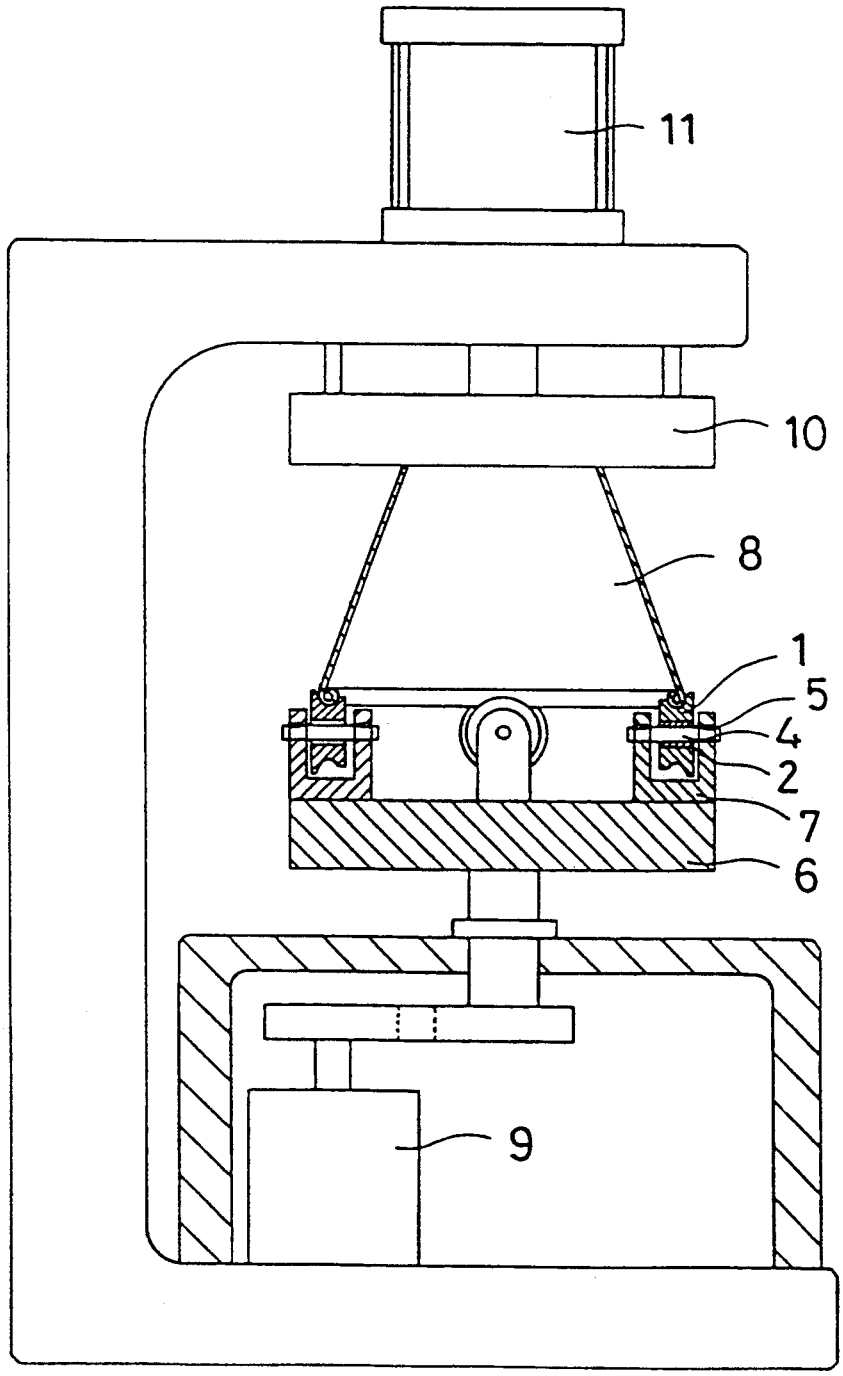
FIG. 1 illustrates a side-view cross section of the curling apparatus which shows the first embodiment of the present invention.
Figure 2:
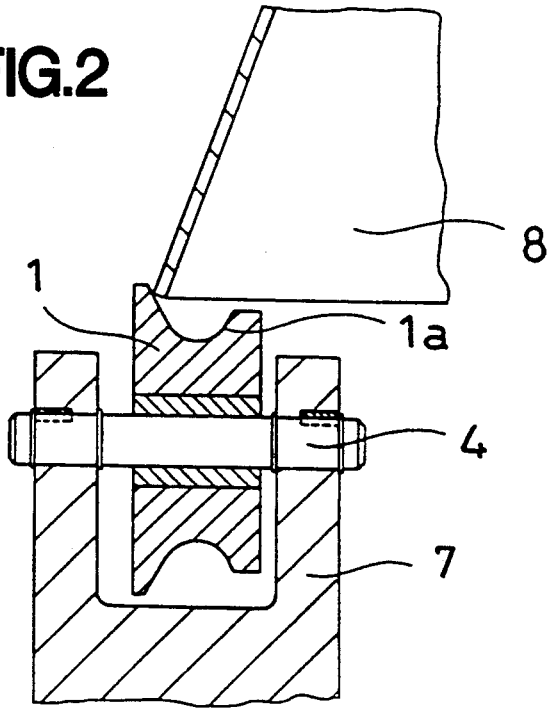
FIG. 2 to FIG. 4 illustrate enlarged cross sections of major parts which show a working process.
Figure 3:
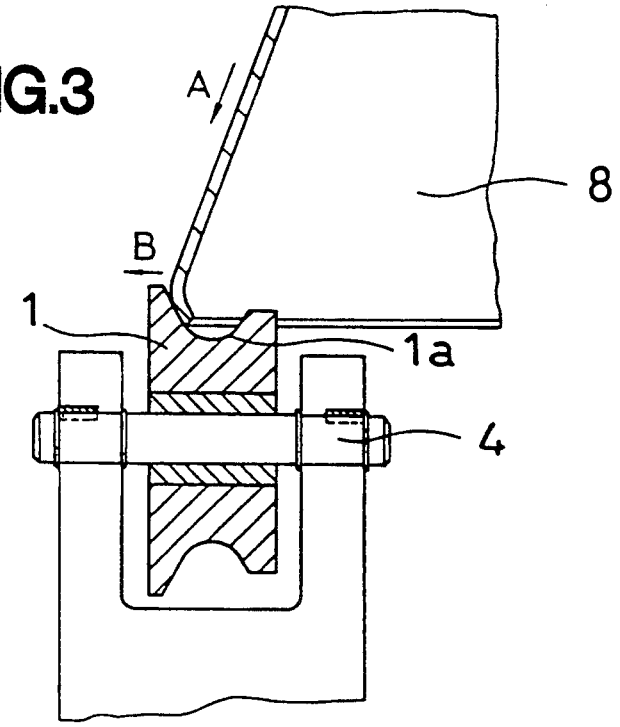
Figure 4:
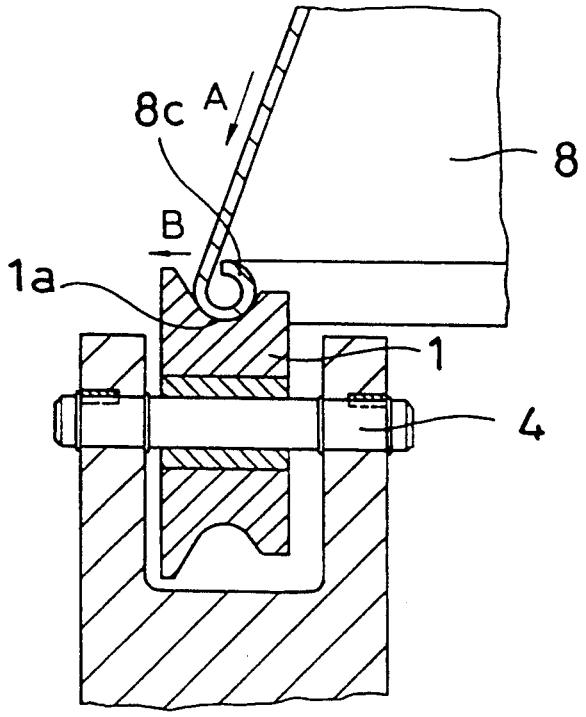
Figure 5:
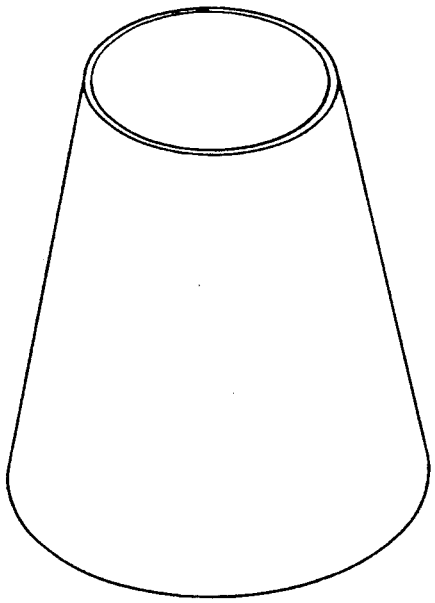
FIG. 5 illustrates a perspective illustration of the tapered cylinder conducted by the first embodiment.

FIG. 1 illustrates a side-view cross section of the curling apparatus which shows the first embodiment of the present invention, FIG. 2 to FIG. 4 illustrate enlarged cross sections of major parts showing steps in the curling process, FIG. 5 illustrates a perspective illustration of the tapered cylinder at the completion of the process.

Figure 11:
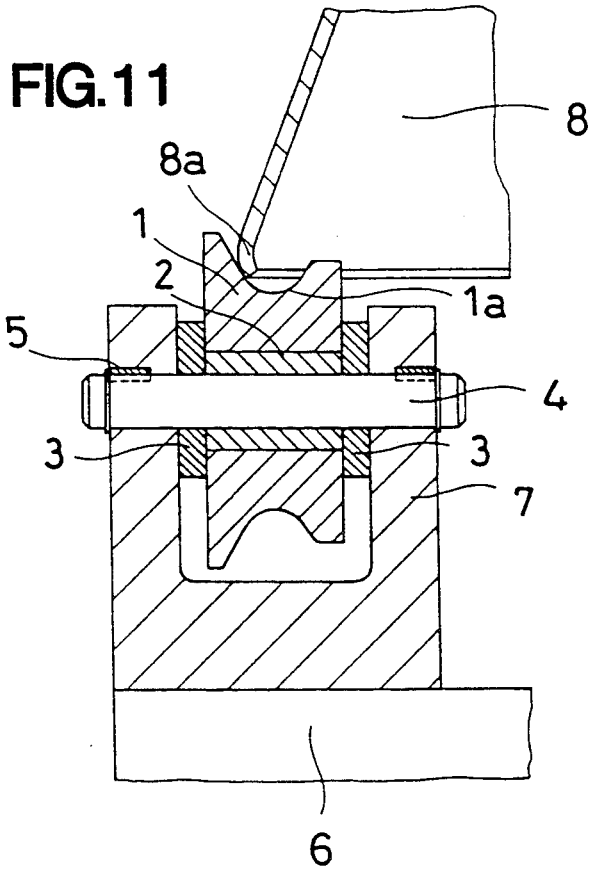
FIG. 11 and FIG. 12 illustrate enlarged cross sections of major parts showing the conventional curling apparatus.
Figure 12:
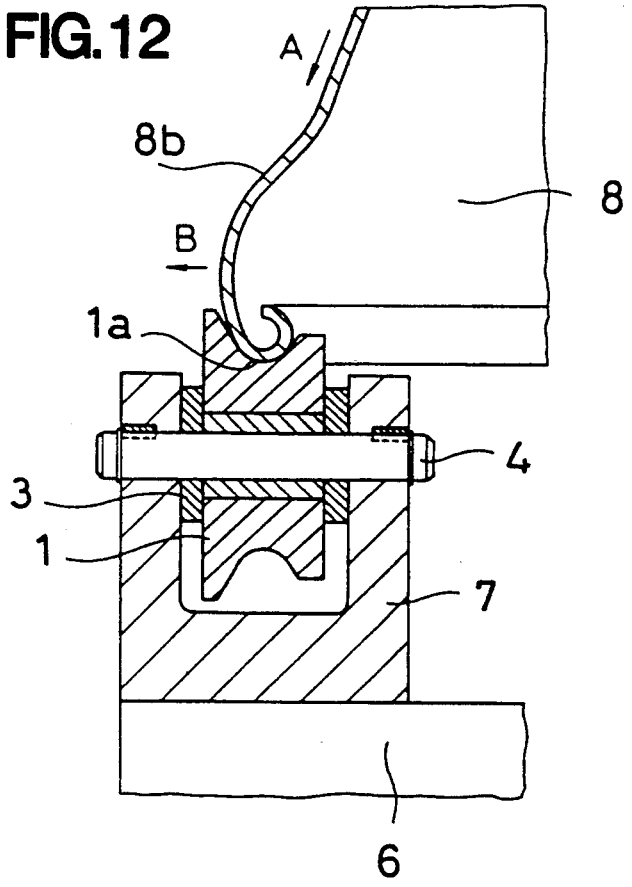
Figure 13:
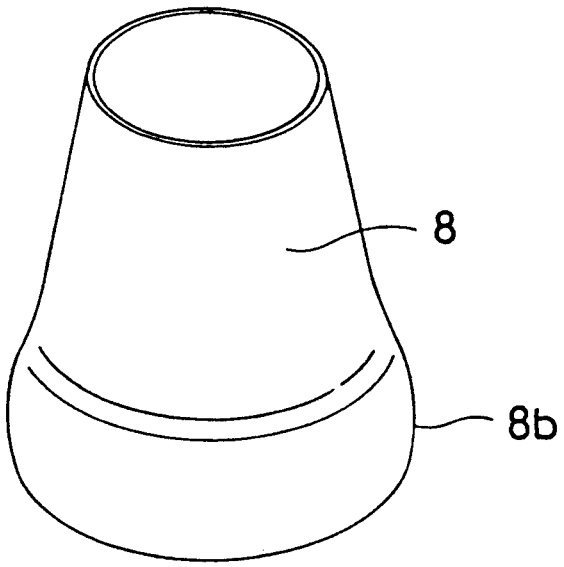
FIG. 13 illustrates a perspective illustration showing a tapered cylinder processed by a conventional curling apparatus.

In FIG. 1, a different between the present embodiment and the conventional example as shown in FIG. 11 is that, in the present embodiment, there is no thrust bearing 3 to bear a radial load generated on the roll 1, thus making roll 1 universally slidable along the axis of the supporting shaft 4. Since other aspects of the present embodiment are equal to the conventional example, a further explanation is omitted by attaching the same symbols to the same component parts which constitute the roll table. In this case, the swiveling table 6 is rotated by a driving device 9, and a slide table 10 which gives pressure in a downward direction to the tapered cylinder 6 is actuated by an actuator 11 which utilizes oil hydraulic pressure and the like.

Explanation follows below of the operation of the curling apparatus thus structured above with reference to FIG. 2 through FIG. 4.

As illustrated in FIG. 2, in the present embodiment, the tapered cylinder 8 is not performed but is directly mounted on the V-groove 1*a* on the roll 1. Then, by operating the driving device 9 with the swiveling table 6 rotated, the tapered cylinder 8 is pressed against the roll 1 by operating the actuator 11.

As illustrated in FIG. 3, the lower end of the tapered cylinder 8 is curved inside along the outer slant face of the V-groove 1*a*, and the roll 1 slides outward on the supporting shaft 4 by the component of force as shown with an arrow B which is generated at that time. Then, upon pressing down, tapered cylinder 8 is curved inside along the circular arc face of the bottom of the V-groove 1*a*, thus forming a curled area 8*a*. In this manner, the component of force as shown with an arrow B does not work as a force to deform the tapered cylinder 8 because the roll 1 escapes along the axis of the supporting shaft, and thus as shown in FIG. 5, the curling work for the tapered cylinder 8 is completed with the conical surface being kept.

Figure 6:
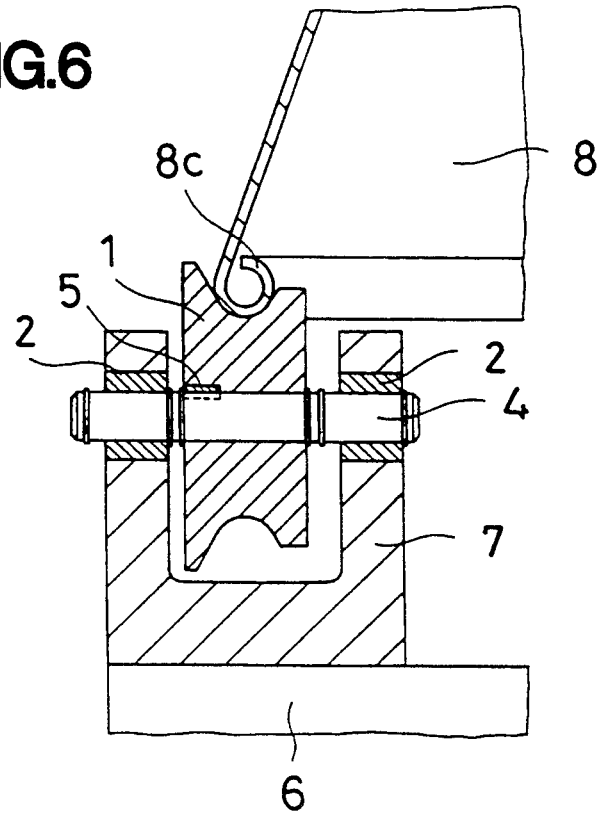
FIG. 6 through FIG. 8 illustrate enlarged cross sections of major parts of the curling apparatus which show respectively the second, third and forth embodiments.

Explanation follows below of the second embodiment of the present invention on an enlarged cross section of the major part with reference to FIG. 6.

The present embodiment differs from the first embodiment as shown in FIG. 1 in that, by mounting a radial bearing 2 on a supporting stand 7, a roll 1 is fastened with use of the key 5 to the supporting shaft 4 which is supported freely rotatable around and slidable on the radial bearing.

Also in the present embodiment, as the roll 1 is able to freely escape in a radial direction, a curled area 8*c* is formed without generating a bulge 8*b* in the same case as the first embodiment.

Figure 7:
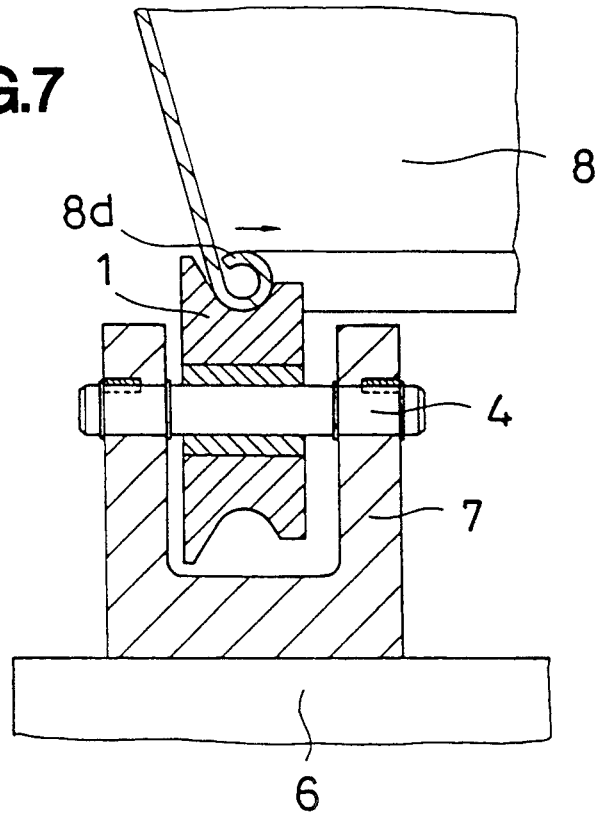
Figure 8:
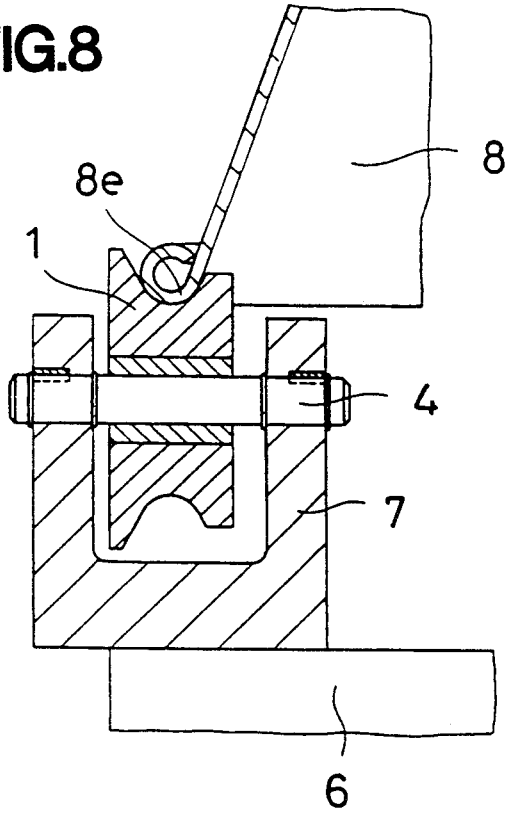

Explanation follows below of the third and fourth embodiments of the present invention with reference to FIG. 7 and FIG. 8.

In both embodiments, the roll 1 as shown in the first embodiment uses a roll table which slides in a radial direction of a swiveling table 6 on the supporting shaft 4, and changes fastening position on a swiveling table 6 respectively, and in the third embodiment, a curled area 8*d* is formed inside the end of the smaller diameter of the tapered cylinder 8, and also in the fourth embodiment, a curled area 8*e* is formed outside the end of larger diameter of the tapered cylinder 8.

Figure 9:
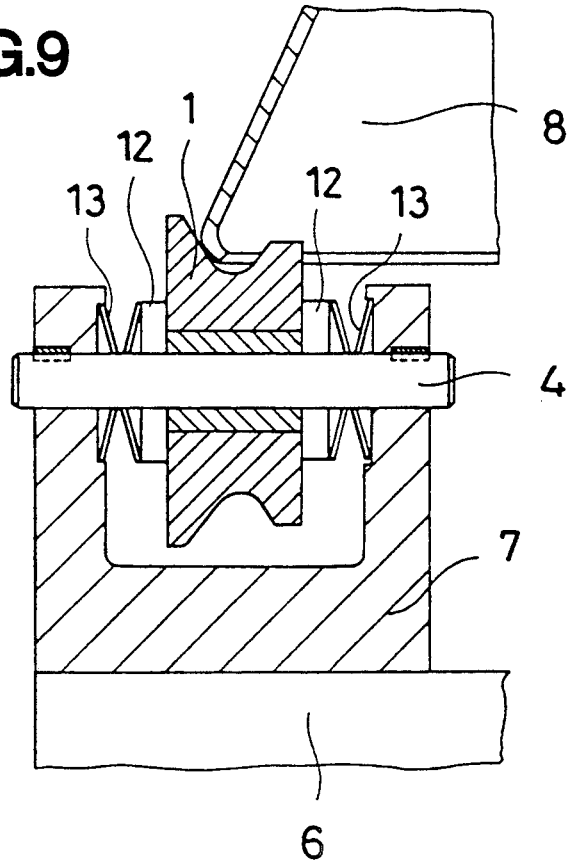
FIG. 9 and FIG. 10 illustrate enlarged cross sections of major parts of the curling apparatus which show the fifth embodiment.
Figure 10:
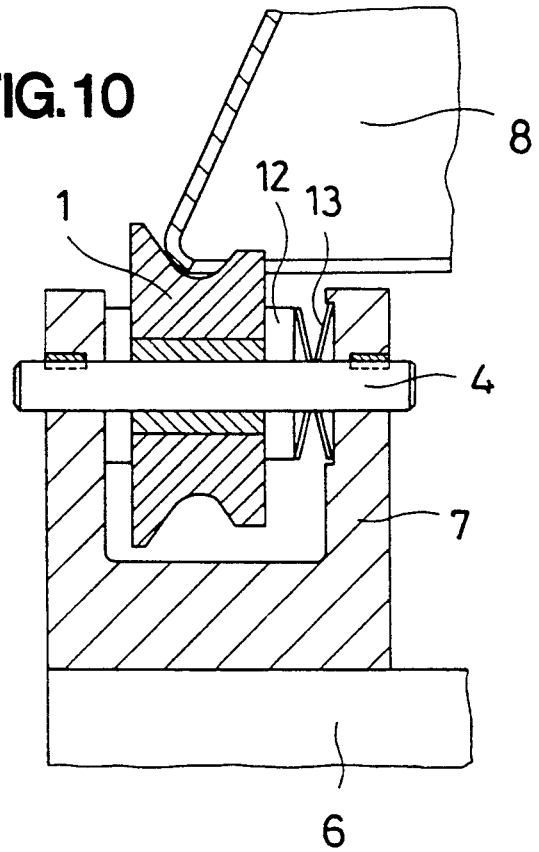

Furthermore, FIG. 9 and FIG. 10 illustrate the fifth embodiment of the present invention, and the embodiment is shown which has a thrust bearing 12 slidable in a radial direction of the supporting shaft 4 and a spring 13 with elasticity in a radial direction provided on a shaft being coaxially with the supporting shaft 4 between the supporting arms of roll 1 and supporting stand 7. In FIG. 9 the spring 13 is provided on both sides of the roll 1 while in FIG. 10 the spring 13 is provided on one side. This fifth embodiment, enables the first position of the roll 1 to be positioned, thus making the work easy.

In the first and fifth embodiments, a pertinent number of roll tables is arranged. Working force, balance of working force, and working speed vary in accordance with the number of tables.

Also, in all the present embodiments, vertical-type apparatus were used, but horizontal-type apparatus may also suffice the need. Likewise, the position of the swiveling table 6 was fastened, but it is possible to apply pressure by shifting swiveling table 6 up and down. It is also possible to rotate the tapered cylinder 8 in favor of the roll table.

In the present embodiment, although a V-groove 1*a* connected with the bottom through a circular arc was adopted, the same effect is obtained with a U-type or a semicircle type. Furthermore, a tapered cylinder 8 was adopted as a workpiece, but it is needless to say that a circular cylinder may also suffice the need.

As explained above, the neighborhood of the end of the area where curling was made will not generate a deformation (such as bulging) according to the present invention. Also, as moderate pressure is being applied, preforming on the edge of workpiece to be made as with the conventional method is not necessary, thus making the curling possible to a desired shape.

What is claimed is

1. A curling apparatus for curling an end of a tapered cylindrical workpiece comprising:

a swiveling table rotatable about an axis;

a roll table coupled to said swiveling table;

a roll located on said roll table, said roll having a surface including a v-groove formed by connecting, through a circular arc, the bottoms of two conical faces oppositely disposed, said surface of said roll for curling said workpiece; and a shaft for supporting said roll on said roll table, said shaft having an axis for slideably supporting said roll wherein said roll slides freely along said axis so as to move with said tapered cylindrical workpieces as said tapered cylindrical workpiece is curled upon rotation of said swiveling table thereby preventing bulging of said tapered cylindrical workpiece.

2. A curling apparatus according to claim 1, further comprising a spring device situated on one side of said roll for positioning said roll at an initial position prior to curling said end of said tapered cylindrical workpiece.

* * * * *